US005719108A

United States Patent [19]

Wilby et al.

[11] Patent Number: 5,719,108

[45] Date of Patent: Feb. 17, 1998

[54] LUBRICATING OIL ADDITIVES

[75] Inventors: Robert Ian Wilby, Sheffield; Pauline Bowden Jackson, Hull, both of United Kingdom

[73] Assignee: BP Chemicals (Additives) Limited, Hertfordshire, United Kingdom

[21] Appl. No.: 751,611

[22] Filed: Nov. 18, 1996

[30] Foreign Application Priority Data

Nov. 22, 1995 [GB] United Kingdom ..... 9523840

[51] Int. Cl.[6] ..... C10M 149/02; C10M 159/12

[52] U.S. Cl. ..... 508/232; 508/235; 508/289; 508/290; 525/327.6

[58] Field of Search ..... 508/232, 235, 508/287, 290; 525/327.6

[56] References Cited

U.S. PATENT DOCUMENTS

| | | | |
|---|---|---|---|
| 3,235,503 | 2/1966 | De Vries | 508/260 |
| 3,365,399 | 1/1968 | Verdol et al. . | |
| 3,455,827 | 7/1969 | Mehmedbasich et al. . | |
| 4,139,417 | 2/1979 | Marie et al. | 508/263 |
| 4,735,736 | 4/1988 | Chung | 508/233 |

FOREIGN PATENT DOCUMENTS

| | | |
|---|---|---|
| 0 365 288 | 4/1990 | European Pat. Off. . |
| 0 682 102 A2 | 11/1995 | European Pat. Off. . |
| 1121464 | 7/1968 | United Kingdom . |

*Primary Examiner*—Jacqueline V. Howard
*Attorney, Agent, or Firm*—Nixon & Vanderhye

[57] ABSTRACT

Dispersant/VI improvers for lubricating oil compositions are disclosed which comprise the reaction product of (a) a copolymer of octadecene-1 and maleic anhydride, the copolymer having a number average molecular weight from greater than 6300 to less than 12000; and (b) a succinimide prepared from a polyamine and an acyclic hydrocarbyl-substituted succinic acylating agent of the formula:

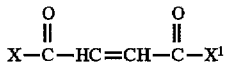

(I)

wherein X and $X^1$ are the same or different; provided that at least one of X and $X^1$ is such that the copolymer can function as a carboxylic acylating agent, and optionally (c) a primary or a secondary hydrocarbyl monoamine or a mixture thereof, preferably an amine of the formula:

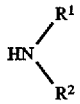

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50, and optionally (d) a compound having at least two primary or secondary amino groups separated by at least three carbon atoms.

27 Claims, No Drawings

LUBRICATING OIL ADDITIVES

The present invention relates generally to additives for use in lubricating oil compositions and to processes for producing the aforesaid additives. In particular, the present invention relates to additives for use as dispersants having viscosity index improver properties.

Operation of internal combustion engines is accompanied by the formation of piston varnish and sludge in the crankcase and in the oil passages of the engine. The sludge and varnish seriously restrict the ability of the crankcase oil to satisfactorily lubricate the engine. Furthermore, the sludge with its entrapped water tends to contribute to rust formation in the engine. To combat the varnish and sludge in internal combustion engines it has long been the practice to incorporate into the lubricating oil additives in the form of dispersants. The dispersants function to disperse the components of varnish and sludge throughout the oil and thereby prevent their accumulation.

It has long been known to use nitrogen-containing compounds as dispersants and/or detergents. Many of the known nitrogen-containing dispersants and/or detergent compounds are based on the reaction of an alkenylsuccinic acid or anhydride with an amine or polyamine to produce an alkenylsuccinimide or an alkenylsuccinamic acid depending upon the nature of the reactants and the reaction conditions. It is also known from, for example U.S. Pat. No. 3,455,827, to produce detergent/dispersants from olefin-maleic anhydride alternating copolymers. Thus, U.S. Pat. No. 3,455,827 discloses compositions comprising the reaction product of olefin-maleic anhydride copolymers with a substituted alkylene polyamine, typically an alkylene polyamine having at least two nitrogen-atoms bonded to a relatively long chain aliphatic hydrocarbon, either through a single bond or a monoxocarbonyl. The copolymers are described as being relatively low molecular weight, having on average from about 6 to 18 recurring units, i.e. units of the formula:

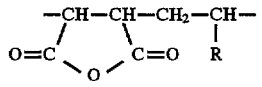

preferably on average about 6 to 14 recurring units.

More recently, the operating demands placed on internal combustion engines have led to a desirability for the dispersant additive to make a viscosity index improver contribution to the additive package sufficient to permit elimination of all or a significant amount of the viscosity index improver additive conventionally employed in such packages.

U.S. Pat. No. 3,365,399 discloses the addition to a base oil of lubricating viscosity of small effective amounts of the base oil-soluble reaction product of a monoamine e.g. octadecylamine, and certain polyamines e.g. diethylaminopropylamine, with a polymer resin of a monovinyl compound of 2 to 12 carbon atoms and maleic anhydride e.g. a polymer of styrene and maleic anhydride. This provides the base oil with excellent dispersant properties as well as excellent basicity by virtue of the nitrogen atoms present and additionally improved pour point and viscosity index.

Our own EP-A-0365288 discloses a process for producing a dispersant/VI improver, that is a product which acts primarily as a dispersant but which may also have viscosity index improving properties, for use in finished lubricating oil compositions, the process comprising reacting in a normally liquid substantially inert organic solvent (a) a copolymer of an olefin and a monomer having the structure:

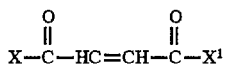

(I)

wherein X and $X^1$ are the same or different provided that at least one of X and $X^1$ is such that the copolymer can function as a carboxylic acylating agent, (b) a succinimide, and (c) a primary or secondary amine, or a mixture thereof.

Copolymers said to be useful in the process of the invention are those derived preferably from a $C_4$ to $C_{30}$ olefin and having a molecular weight preferably in the range 5000 to 50,000.

Our own EP-A-682102 provides a process for preparing a lubricating oil additive comprising reacting at elevated temperature (a) a copolymer of an olefin such as polyoctadecene-1 and a monomer having the structure

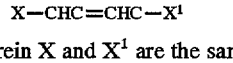

(I)

wherein X and $X^1$ are the same or different provided that at least one of X and $X^1$ is such that the copolymer can function as a carboxylic acylating agent, and (b) a succinimide prepared from an acyclic hydrocarbyl substituted succinic acylating agent and a polyamine wherein the hydrocarbyl substituted succinic acylating agent is prepared by reacting a polyolefin and an acylating agent of formula I under conditions such that at least 75 mole % of the starting polyolefin is converted to the hydrocarbyl-substituted succinic acylating agent.

We have now found that for dispersant/VI improvers derived from maleic anhydride/polyoctadecene-1 copolymers the VI contribution is dependent on the molecular weight of the copolymer, being at an optimum over a number average molecular weight in the range from greater than 6,300 to less than 12,000, corresponding to an average of from greater than 18 to less than 34 recurring units.

Accordingly the present invention provides a dispersant/VI improver additive for lubricating oil compositions, which comprises the reaction product of (a) a copolymer of octadecene-1 and maleic anhydride, the copolymer having a number average molecular weight from greater than 6300 to less than 12000; and (b) a succinimide prepared from a polyamine and an acyclic hydrocarbyl-substituted succinic acylating agent of the formula:

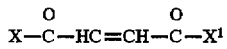

(I)

wherein X and $X^1$ are the same or different; provided that at least one of X and $X^1$ is such that the copolymer can function as a carboxylic acylating agent. A further aspect of the invention comprises the use of the above defined reaction product as a dispersant/VI improver for lubricating oil compositions.

For the avoidance of doubt the molecular weights referred to throughout this specification in relation to the copolymer of octadecene-1 and maleic anhydride are the molecular weights as measured by Gel Permeation Chromatography (GPC) against polystyrene standards. Preferably the number average molecular weight of the copolymer is in the range from greater than 6,300 to 11,200, more preferably from 6,650 to 8,050, corresponding to an average number of recurring units preferably in the range from greater than 18 to 32, more preferably from 19 to 23. It is understood that such a copolymer is produced by the alternating copolymerisation of octadecene-1 and maleic anhydride as opposed to the reaction of maleic anhydride with a preferred polymer of octadecene-1. The copolymers are readily prepared by the copolymerisation of maleic anhydride and octadecene-1 by refluxing the two together in a hydrocarbon solvent in the presence of a free radical polymerisation initiator. A suitable method is described in, for example, GB-A-1,121,464 (Monsanto Co.).

Preferably the succinimide (b) is prepared under conditions such that at least 75, preferably 80 and more preferably 85 mole % of the starting polyolefin is converted to the acyclic hydrocarbyl substituted succinic acylating agent.

The acyclic hydrocarbyl substituent of the succinic acylating agent may suitably be either an alkyl or alkenyl group, preferably an alkyl group. The substituent is suitably derived from a polyolefin homopolymer or copolymer having a number average molecular weight in the range from about 500 to about 5000, typically from 750 to 1500. The olefin suitably has from 2 to 16 carbon atoms, preferably from 2 to 6 carbon atoms. The copolymers include random, block and tapered copolymers. Suitable olefin monomers include ethylene, propylene, butenes, isobutene and pentenes. The acyclic hydrocarbyl substituent is preferably derived from a polyisobutene (PIB). There may be used to advantage highly reactive PIBs, that is PIBs wherein greater than 50%, preferably greater than 65%, more preferably greater than 80% of the residual olefinic double bonds are of the vinylidene type, i.e. represented by the formula:

$$-CH_2-\underset{\underset{CH_3}{|}}{C}=CH_2 \qquad \text{(II)}$$

Highly reactive PIBs are commercially available in the form of ULTRAVIS (RTM) from BP Chemicals Limited and GLISSOPAL (RTM) from BASF.

Alternatively, there may be used PIBs wherein less than 50% of the olefin double bonds are of the vinylidene type provided that at least 75 mole % of the starting PIB is converted to the PIB substituted succinic acylating agent. These, too, are commercially available as HYVIS (RTM) from BP Chemicals Limited, amongst others. Mixtures of PIBs may also be used in the derivation of the acyclic hydrocarbyl substituent. It is preferred to use a mixture of a PIB having a molecular weight in the range from 750 to 1500 with up to 40% by weight of a PIB having a molecular weight greater than 1500, for example up to 5000, typically about 2400.

Acyclic hydrocarbyl-substituted succinic acylating agents include the hydrocarbyl-substituted succinic acids, the hydrocarbyl-substituted succinic anhydrides, the hydrocarbyl-substituted succinic acid halides, and the esters of the hydrocarbyl-substituted succinic acids, anhydrides or halides and lower alcohols, for example $C_1$ to $C_6$ alcohols, that is hydrocarbyl-substituted compounds which can function as carboxylic acylating agents. Of these compounds the hydrocarbyl-substituted succinic acids and the hydrocarbyl-substituted succinic anhydrides and mixtures of such acids and anhydrides are preferred. More preferred are the hydrocarbyl-substituted succinic anhydrides, in particular PIB succinic anhydrides.

The succinic acylating agent is preferably made by reacting a polyolefin as described hereinbefore, in the presence or the absence of a halogen, preferably chlorine, at elevated temperature with maleic anhydride. Halogen-free products, preferred in certain applications, are ultimately obtainable by avoiding the use of halogen at this stage in the preparation of succinimide dispersants. As an alternative to maleic anhydride there may be used, for example, maleic acid, fumaric acid, malic acid, itaconic acid, itaconic anhydride, and the like. Where the polyolefin (e.g. PIB) is a polyolefin wherein less than 50% of the olefin double bonds are vinylidene, the succination is likely to be carried out in the presence of chlorine; in this case the reaction can be carried out in 2 steps, the first step being the chlorination of the polyolefin, the second step being the reaction of the chloro derivative with the maleic anhydride or like product.

Reactant (b) is prepared from a succinic acylating agent as described above and a polyamine which can be an alkylene polyamine. Suitable alkylene polyamines are those of the formula:-

$$HR^2N(R^1NH)_xR^1NH\ R^3 \qquad \text{(III)}$$

wherein $R^1$ is an alkylene moiety of 2 to 10 carbon atoms, $R^2$ and $R^3$ are independently either hydrogen, alkyl groups, preferably $C_1$ to $C_6$ alkyl groups, more preferably methyl or ethyl, or hydroxyalkyl, preferably $C_1$ to $C_6$ hydroxyalkyl and x is an integer in the range from 0 to 10. The alkylene moiety $R^1$ preferably has from 2 to 6 carbon atoms and is more preferably either ethylene or propylene or a mixture thereof. $R^2$ and $R^3$ in the formula (III) are preferably both hydrogen. x preferably is equal to or greater than 2. Examples of alkylene polyamines having the formula (III) include diethylene triamine, triethylene tetramine, tripropylene tetramine, tetraethylene pentamine, tetrapropylene pentamine and pentaethylene hexamine. A preferred alkylene polyamine is tetraethylene pentamine. Alternatively, instead of the alkylene polyamine there may be used one or more polyoxyalkylene polyamines having the formula:-

$$H_2N\text{—alkylene(O-alkylene)}_m NH_2 \qquad \text{(IV)}$$

where m has a value of about 3 to 70, preferably 10 to 35.

The polyoxyalkylene polyamines of the formula (IV), may suitably have average molecular weights ranging from about 200 to about 4000, preferably from about 400 to about 2000. Preferred polyoxyalkylene polyamines include the polyoxyethylene and polyoxypropylene diamines and the polyoxypropylene triamines having average molecular weights of from about 200 to 2000. The polyoxyalkylene polyamines are commercially available and may be obtained, for example, from the Jefferson Chemicals Company Inc. under the trade name JEFFAMINES (RTM), e.g. D-230, D-400, D-1000, D-2000, T-403 etc.

Reactants (a) and (b) are preferably reacted in the presence of a normally liquid substantially inert organic solvent. Preferably the solvent is a high-boiling hydrocarbon solvent. Examples of suitable such solvents include higher carbon number paraffins and liquid polyolefins. In view of the intended use of the product it is preferred to employ as the solvent an oil of lubricating viscosity. Both natural and synthetic oils may be employed. Solvent neutral (SN) oils, for example SN150 oil, are the oils of choice.

Reactant (b) may be added to reactant (a) as a pre-formed succinimide or as the precursors of reactant (b) i.e. the acyclic hydrocarbyl substituted succinic acylating agent and a polyamine.

The ratio of reactants (a) to (b) to solvent is suitably such that the product of the reaction forms a concentrate composition in the solvent. The concentrate composition suitably comprises from 10 to 80% by weight of the product.

The elevated temperature at which reactants (a) and (b) are reacted may suitably be in the range from 75° to 300° C., preferably from 130° to 200° C.

Optionally there may be incorporated into the reaction mixture as reactant (c) a primary or a secondary hydrocarbyl monoamine (or a mixture thereof) wherein the hydrocarbyl substituent is of a length such as to render the product soluble in the solvent therefor. Suitable amines have the formula:

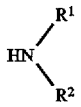

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is at least 6 and as high as 50.

Preferably $R^2$ in the formula (V) is hydrogen, i.e. the amine is a primary amine. Preferably $R^1$ is an alkyl group. Preferably the total number of carbon atoms in the groups $R^1$ and $R^2$ is in the range from 8 to 20, more preferably from 10 to 18. Examples of suitable amines include octadecylamine and dodecylamine. An example of a suitable mixture of amines is tallow amine (a partially saturated mixture of amines comprised mainly of $C_{18}$ amines).

There may also be incorporated into the reaction mixture a compound having at least two primary or secondary amino groups separated by at least three carbon atoms (reactant (d)). An example of a compound suitable for use as reactant (d) is diaminododecane. It is possible to use polyalkylene polyamines or polyoxyalkylene polyamines as reactant (d). Suitable polyalkylene polyamines are polyethylene polyamines for example tetraethylene pentamine (TEPA) and triethylenetetramine (TETA).

The reaction can be effected simply by mixing the reactants (a) and (b), solvent and optionally (c) and (d), suitably at room temperature, raising the temperature thereafter to the desired elevated temperature and holding the mixture at the elevated temperature for a time sufficient to complete the reaction.

One method of obtaining the product comprises in a first step reacting reactant (b) with reactant (d)+(c) in the presence of the solvent at a temperature in the range from 100° to 200° C., for example about 140° C., and in a second step reacting the product of the first step with reactant (a) at a temperature in the range from 100° to 200° C.

In another aspect the present invention provides a process for the production of a dispersant/VI improver additive for lubricating oil compositions which process comprises reacting at elevated temperature:

(a) a copolymer of octadecene-1 and maleic anhydride, the copolymer having a number average molecular weight in the range from greater than 6,300 to less than 12,000, and
(b) a succinimide prepared from a polyamine and an acyclic hydrocarbyl-substituted succinic acylating agent.

In all respects the reactant (a) and (b) and the process conditions are as hereinbefore described.

Furthermore we have found that if instead of using a preformed succinimide in the process of EP-A-0365288 referred to above there are used the precursors of a succinimide, there can be obtained a comparable product. By eliminating a step in the process of EP-0365288 the process is rendered more economical. In this case, the process and products thereof are as detailed above with the proviso that the succinimide is added to the copolymer (a) in the form of its precursors i.e. the acyclic hydrocarbyl substituted succinic acylating agent and a polyamine, and that the hydrocarbyl substituted succinic acylating agent is not restricted with regard to the extent of conversion of the starting polyolefin in its preparation.

Accordingly, there is provided a process comprising reacting at elevated temperature preferably in a normally liquid substantially inert organic solvent:

(a) a copolymer of octadecene-1 and maleic anhydride, the copolymer having a number average molecular weight in the range from greater than 6,300 to less than 12,000,
(b) an acyclic hydrocarbyl-substituted succinic acylating agent, and
(c) an alkylene polyamine.

In a further aspect the present invention provides a finished lubricating oil composition comprising a major proportion of lubricating oil and a minor proportion of the concentrate prepared by the processes as hereinbefore described. Typically a lubricating oil composition will comprise 2–30% by weight of the concentrate preferably 5–15% for example 10%.

Any oil of lubricating viscosity may be used in the composition. Thus animal, vegetable or mineral oils may be employed. Mineral oils are preferred. Synthetic oils, including synthetic ester lubricating oils and polyolefins may also be used.

The finished lubricating oil composition may contain conventional additives, for example one or more of anti-wear additives, antioxidants, anti-rust additives, detergents, viscosity index improvers, and the like. It is an advantage of the present invention, however, that at least some of the VI improver additive conventionally present in lubricating oil compositions may be omitted. The conventional additives mentioned hereinbefore may be added either directly to the lubricating oil composition or to the concentrate composition.

The invention will now be further illustrated by reference to the following examples. In the examples reference is made to the average molecular weight of the copolymers of 1-octadecene and maleic anhydride. The average molecular weight is the number average molecular weight as measured by GPC against polystyrene standards as follows:

GPC Method for the Molecular Weight Measurement of Octadecene/Maleic Anhydride Copolymer (PODMA)

Principle

PODMA solutions in tetrahydrofuran were injected onto a GPC column set which had been pre calibrated with narrow band polystyrene standards. A standard software package then used the sample retention time's to calculate number and weight average molecular weights as polystyrene equivalents. Toluene was used as a flow rate marker.

Analysis Conditions

Column set: Ultrastyragel $10^4$
Styragel HR4E
Styragel HR2
Styragel HR1
Column temp: 35° C.
Mobile phase: Stabilised Tetrahydrofuran
Flow Rate: 1.0 ml/min
Sample Size: 100 μl
Concentration: 0.5% w/w
Detector: Refractive Index

EXAMPLE 1

To a 1 liter flask fitted with a condenser, overhead stirrer, thermocouples and nitrogen sparge was charged 1-octadecene (317 g; 1.25 moles), maleic anhydride (307 g; 3.125 moles), mixed xylenes (245 g) and tertiary butylperoxide (1.4 g; 9.58 mmoles). This was heated to 120° C. using a heating mantle and eurotherm and using constant agitation under a blanket of nitrogen. The reaction was held at this temperature for 5 hours. Thereafter a still head, condenser and receiver flask were attached to the reaction flask and vacuum was slowly applied in order to remove the xylene solvent. Once the xylenes had been removed the temperature was increased to 180°–200° C. under 29 inches Hg (98.13 kPa) vacuum and maleic anhydride was removed. The product was allowed to cool giving a straw-coloured resin that gave a white powder when ground. The product had an average molecular weight of 7040 (equivalent to 20.1 repeating units).

EXAMPLE 2

The apparatus was set up in the manner described in Example 1. The 1-liter reaction flask was charged with 1-octadecene (317 g; 1.25 moles), maleic anhydride (245.8 g; 2.5 moles), mixed xylenes (265.5 g) and tertiary butylperoxide (1.33 g; 9.1 mmoles). The method described in Example 1 was followed except that the reaction was held at 142° C. for 5 hours. The product had an average molecular weight of 6911 (equivalent to 19.7 repeating units).

Comparison Test 1

The apparatus was set up in the manner described in Example 1. To the 1-liter reaction flask was charged 1-octadecene (317 g; 1.25 moles), maleic anhydride (307 g; 3.125 moles), mixed xylenes (245 g) and tertiary butylperoxide (1.8 g; 12.3 mmoles). The method described in Example 1 was followed except that the reactants were held at 142° C. for 3 hours. The average molecular weight of the resulting polymer was found to be 5288 (equivalent to 15.8 repeating units).

Comparison Test 2

The apparatus was set up in the manner described in Example 1. To the 1-liter reaction flask was charged 1-octadecene (317 g; 1.25 moles), maleic anhydride (306.8 g; 3.125 moles), mixed xylenes (250 g), 1-octadecene/maleic anhydride copolymer as a heel (13.0 g; 37.1 mmoles of repeating units) and tertiary butylperoxide (2.2 g; 15.0 mmoles). The method described in Example 1 was followed except that the reactants were held at 145° C. for 8 hours. The product had an average molecular weight of 5345 (equivalent to 15.3 repeating units).

Comparison Test 3

A 500 ml flask fitted with an overhead stirrer and thermocouples was charged with GLISSOPAL (RTM) polyisobutylene tetraethylene pentamine (TEPA) succinimide as a solution in oil (183.4 g of which 26.5 mmoles was mono-succinimide and 17.6 mmoles was bis-succinimide), octadecene/maleic anhydride copolymer as per Comparison Test 1 (as a 25% solution in PIBSA and mineral oil) (86 g; 61.4 mmoles of repeating units) and mineral oil (42.6 g). This was heated using a heating mantle and eurotherm to 150° C. with constant agitation. The flask was allowed to vent to atmosphere. The reactants were held at 150° C. for 4 hours. The resulting product was a very viscous brown liquid which when blended into a finished oil formulation had a viscosity at 100° C. of 22.33 cS and a viscosity at −15° C. of 2920 cP. The product contained 50.8% actives.

EXAMPLE 3

A 500 ml flask was charged with GLISSOPAL (RTM) polyisobutylene TEPA succinimide as a solution in oil (183.4 g; 26.5 mmoles as mono-succinimide and 17.6 mmoles as bis-succinimide), maleic anhydride/octadecene copolymer prepared as in Example 1 and used as a 25% solution in PIBSA and mineral oil (86 g; 61.4 mmoles of repeating units) and mineral oil (42.6 g). The method described in Comparison Test 3 was followed and the resulting product when blended into a finished oil formulation had a viscosity at 100° C. of 15.90 cS and a viscosity at −15° C. of 2440 cP.

EXAMPLE 4

The method described in Example 3 was followed using the same charge except that instead of the copolymer of Example 1 there was used the copolymer of Example 2. The resultant product when blended into a finished oil formulation had a viscosity at 100° C. of 15.89 cS and a viscosity at −15° C. of 2570 cP.

Comparison Test 4

The charges were the same as those described in Comparison Test 3 and Examples 3 and 4 except that the copolymer was prepared as described in Comparison Test 4 and in this instance was used in the form of a powder (21.5 g; 61.4 mmoles of repeating units) and the mineral oil charge was increased to 105.5 g. The flask was heated with constant agitation to 150° C. The vessel was allowed to vent to atmosphere. The reactants were held at 150° C. for 4 hours. After this time, TEPA (2.5 g; 13.2 mmoles) was added and the reaction held at 150° C. for one further hour. The resultant dispersant had a nitrogen content of 1.2% and when blended into a finished oil formulation had a viscosity at 100° C. of 15.32 cS and a viscosity at −15° C. of 2730 cP.

The results of Comparison Tests 3 and 4 and Examples 3 and 4 are presented in the accompanying Table together with the measured viscosities at 100° C. and −15° C. of a commercially available 1-octadecene/maleic anhydride alternating copolymer having a number average molecular weight of 12,000 (corresponding to 34 repeat units) blended into a finished oil formulation in an identical manner to Examples 3 and 4 and Comparison Tests 3 and 4.

TABLE

| Example | Origin of Copolymer (Ex. No.) | Number Average Molecular Weight of Copolymer | No. of Copolymer Repeat Units | Viscosity at 100° C. cS | Viscosity at −15° C. cP |
|---|---|---|---|---|---|
| Comp. Test 3 | Comp. Test 1 | 5288 | 15.8 | 22.33 | 2920 |
| 3 | 1 | 7040 | 20.1 | 15.90 | 2440 |
| 4 | 2 | 6911 | 19.7 | 15.89 | 2570 |
| Comp. Test 4 | Comp. Test 2 | 5345 | 15.3 | 15.32 | 2730 |
| Commercial Product | | 12000 | 34.3 | 14.3 | 2850 |

On the basis that the higher the viscosity at 100° C. and the lower the viscosity at −15° C. the better the viscometrics of the product it can be seen from the Table that the products of Examples 3 and 4 are viscometrically better than the commercial product and better in terms of low temperature viscosity than the products of the Comparison Tests 3 and 4.

We claim:

1. A dispersant/VI improver additive for lubricating oil compositions, which comprises the reaction product of (a) a copolymer of octadecene-1 and maleic anhydride, the copolymer having a number average molecular weight from greater than 6300 to less than 12000; and (b) a succinimide prepared from a polyamine and an acyclic hydrocarbyl-substituted succinic acylating agent of the formula:

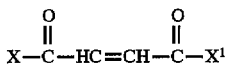

(I)

wherein X and $X^1$ are the same or different; provided that at least one of X and $X^1$ is such that the copolymer can function as a carboxylic acylating agent.

2. Additive according to claim 1, wherein the copolymer of octadecene-1 and maleic anhydride has a number average molecular weight of from greater than 6300 to 11200.

3. Additive according to claim 1, wherein the copolymer of octadecene-1 and maleic anhydride has a number average molecular weight of from 6650 to 8050.

4. Additive according to claim 1, wherein the acyclic hydrocarbyl substituent of the succinic acylating agent is an alkyl or alkenyl group.

5. Additive according to claim I, wherein the acyclic hydrocarbyl substituent of the succinic acylating agent is derived from a polyolefin homopolymer or copolymer having a number average molecular weight from 500 to 5000.

6. Additive according to claim 1, wherein the acyclic hydrocarbyl substituent of the succinic acylating agent is derived from a polyolefin homopolymer or copolymer having a number average molecular weight from 750 to 1500.

7. Additive according to claim 1, wherein the acyclic hydrocarbyl substituent is derived from a polyisobutene (PIB).

8. Additive according to claim 1, wherein the acyclic hydrocarbyl-substituted succinic acylating agent comprises a hydrocarbyl-substituted succinic acid, a hydrocarbyl-substituted succinic anhydride, a hydrocarbyl-substituted succinic acid halide, or an ester of a hydrocarbyl-substituted succinic acid, anhydride or halide and a lower alcohol.

9. Additive according claim 1, wherein the polyamine precusor of (b) is an alkylene polyamine of the formula:

$$HR^2N(R^1NH)_xR^1NHR^3 \quad \text{(III)}$$

wherein x is an integer in the range from 0 to 10, $R^1$ is an alkylene moiety of from 2 to 10 carbon atoms, and $R^2$ and $R^3$ are each independently either hydrogen, hydroxyalkyl, or an alkyl group.

10. Additive according to claim 1, wherein the polyamine precusor of (b) is a polyoxyalkylene polyamine of the formula:

$$H_2N\text{—alkylene(O-alkylene)}_mNH_2 \quad \text{(IV)}$$

where m is from 3 to 70, and the average molecular weight is from 200 to 4000.

11. Additive according to claim 1, which comprises the reaction product of (a), (b) and additionally (c) a primary or a secondary hydrocarbyl monoamine or a mixture thereof, preferably an amine of the formula:

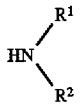

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50.

12. Additive according to claim 1, which comprises the reaction product of (a), (b), optionally (c) a primary or a secondary hydrocarbyl monoamine or a mixture thereof, preferably an amine of the formula:

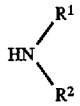

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50, and optionally (d) a compound having at least two primary or secondary amino groups separated by at least three carbon atoms.

13. Additive according to claim 1, which comprises the reaction product of (a), (b), optionally (c) a primary or a secondary hydrocarbyl monoamine or a mixture thereof, preferably an amine of the formula:

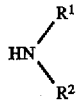

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50, and optionally (d) diaminododecane or a polyalkylene polyamine or polyoxyalkylene polyamine.

14. Process for the production of a dispersant/VI improver additive for lubricating oil compositions which process comprises reacting at elevated temperature:

(a) a copolymer of octadecene-1 and maleic anhydride, the copolymer having a number average molecular weight of from greater than 6300 to less than 12000, preferably from greater than 6300 to 11200 and more preferably from 6650 to 8050; and (b) an alkylene polyamine and an acyclic hydrocarbyl-substituted succinic acylating agent both optionally as defined in any of claims 3 to 8, or a succinimide prepared therefrom.

15. Process according to claim 14, wherein the copolymer of octadecene-1 and maleic anhydride has a number average molecular weight of from greater than 6300 to 11200.

16. Process according to claim 14, wherein the copolymer of octadecene-1 and maleic anhydride has a number average molecular weight of from 6650 to 8050.

17. Process according to claim 14, wherein the acyclic hydrocarbyl substituent of the succinic acylating agent is an alkyl or alkenyl group.

18. Process according to claim 14, wherein the acyclic hydrocarbyl substituent of the succinic acylating agent is derived from a polyolefin homopolymer or copolymer having a number average molecular weight from 500 to 5000.

19. Process according to claim 14, wherein the acyclic hydrocarbyl substituent of the succinic acylating agent is derived from a polyolefin homopolymer or copolymer having a number average molecular weight from 750 to 1500.

20. Process according to claim 14, wherein the acyclic hydrocarbyl substituent is derived from a polyisobutene (PIB).

21. Process according to claim 14, wherein the acyclic hydrocarbyl-substituted succinic acylating agent comprises a hydrocarbyl-substituted succinic acid, a hydrocarbyl-substituted succinic anhydride, a hydrocarbyl-substituted succinic acid halide, or an ester of a hydrocarbyl-substituted succinic acid, anhydride or halide and a lower alcohol.

22. Process according claim 14, wherein the polyamine precusor of (b) is an alkylene polyamine of the formula:

$$HR^2N(R^1NH)_xR^1NHR^3 \quad \text{(III)}$$

wherein x is an integer in the range from 0 to 10, $R^1$ is an alkylene moiety of from 2 to 10 carbon atoms, and $R^2$ and $R^3$ are each independently either hydrogen, hydroxyalkyl, or an alkyl group.

23. Process according to claim 14, wherein the polyamine precusor of (b) is a polyoxyalkylene polyamine of the formula:

$$H_2N\text{—alkylene(O-alkylene)}_m\text{NH}_2 \quad \text{(IV)}$$

where m is from 3 to 70, and the average molecular weight is from 200 to 4000.

24. Process according to claim 14, which comprises reacting (a), (b) and additionally (c) a primary or a secondary hydrocarbyl monoamine or a mixture thereof, preferably an amine of the formula:

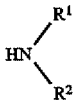

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50.

25. Process according to claim 14, which comprises reacting (a), (b), optionally (c) a primary or a secondary hydrocarbyl monoamine or a mixture thereof, preferably an amine of the formula:

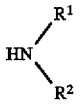

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50, and optionally (d) a compound having at least two primary or secondary amino groups separated by at least three carbon atoms.

26. Process according to claim 14, which comprises reacting (a), (b), optionally (c) a primary or a secondary hydrocarbyl monoamine or a mixture thereof, preferably an amine of the formula:

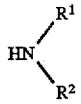

(V)

wherein $R^1$ is either a saturated or an unsaturated aliphatic hydrocarbyl group, and $R^2$ is either $R^1$ or hydrogen, and the total number of carbon atoms in the groups $R^1$ and $R^2$ is from 6 to 50, and optionally (d) diaminododecane or a polyalkylene polyamine or polyoxyalkylene polyamine.

27. A finished lubricating oil composition comprising a major proportion of lubricating oil and 2 to 30% by weight of an additive which comprises the reaction product of (a) a copolymer of octadecene-1 and maleic anhydride, the copolymer having a number average molecular weight from greater than 6300 to less than 12000; and (b) a succinimide prepared from a polyamine and an acyclic hydrocarbyl-substituted succinic acylating agent of the formula:

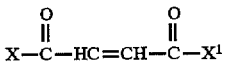

(I)

wherein X and $X^1$ are the same or different; provided that at least one of X and $X^1$ is such that the copolymer can function as a carboxylic acylating agent.

* * * * *